United States Patent [19]

Schreiner et al.

[11] Patent Number: 4,681,702

[45] Date of Patent: Jul. 21, 1987

[54] SINTERED, ELECTRICAL CONTACT MATERIAL FOR LOW VOLTAGE POWER SWITCHING

[75] Inventors: Horst Schreiner; Bernhard Rothkegel, both of Nuremberg, Fed. Rep. of Germany

[73] Assignee: Siemens Aktiengesellschaft, Berlin and Munich, Fed. Rep. of Germany

[21] Appl. No.: 865,932

[22] Filed: May 16, 1986

Related U.S. Application Data

[63] Continuation of Ser. No. 577,750, Feb. 7, 1984, abandoned.

[30] Foreign Application Priority Data

Oct. 2, 1983 [DE] Fed. Rep. of Germany ..... 3304637

[51] Int. Cl.[4] ..... H01B 1/06

[52] U.S. Cl. ..... 252/518; 200/265; 264/61; 264/65; 264/125

[58] Field of Search ..... 75/234; 252/512, 518; 200/265; 419/21, 22; 264/61, 65, 125

[56] References Cited

U.S. PATENT DOCUMENTS

| | | | |
|---|---|---|---|
| 3,954,459 | 5/1976 | Schreiner et al. | 419/21 |
| 4,141,727 | 2/1979 | Shida et al. | 75/234 |
| 4,204,863 | 5/1980 | Schreiner | 75/234 |
| 4,294,616 | 10/1981 | Kim et al. | 75/234 |
| 4,551,301 | 11/1985 | Schreiner | 75/234 |
| 4,565,590 | 1/1986 | Grosse et al. | 75/234 |

FOREIGN PATENT DOCUMENTS

| | | |
|---|---|---|
| 82610 | 7/1978 | Japan . |
| 43775 | 3/1980 | Japan . |

*Primary Examiner*—Stephen J. Lechert, Jr.
*Attorney, Agent, or Firm*—John Francis Moran

[57] ABSTRACT

Electrical contact materials based on AgCdO with CdO as the main active component have proven to be particularly advantageous for low voltage switchgear in the power industry. However, when switching AgCdO contact materials, CdO, which is classified as toxic, can escape into the environment through burn-off. It is important, therefore, to keep the CdO content as low as possible in the contact material, or to exclude it completely. The contact material according to the invention is a sintered contact material consisting of $AgSnO_2$ with at least two other metal oxide additives; namely, $Bi_2O_3$, CuO and optionally CdO. Relative to $SnO_2$, these additives $Bi_2O_3$, CuO optionally CdO, amount quantitatively to a total maximum of 25 percent by volume of the total amount of oxide.

3 Claims, No Drawings

SINTERED, ELECTRICAL CONTACT MATERIAL FOR LOW VOLTAGE POWER SWITCHING

This application is a continuation of U.S. patent application Ser. No., 577,750 of Feb. 7, 1984, now abandoned, but the subject of a petition to the Commissioner to revive.

The invention relates to a sintered, electrical contact material for low voltage switchgear for the power industry, comprising $AgSnO_2$ and at least two other metal oxide additives.

Contact materials based on AgCdO with CdO as the main active component have proven to be particularly advantageous for low voltage electrical power switchgear, such as contactors or circuit breakers. These contact materials exhibit relatively little burn-off in the arc, a relatively small welding force (the force required to separate contacts which are welded together), and only little heating when carrying continuous current.

Since CdO, which is classified as toxic, can escape into the environment from contact elements consisting of AgCdO through burn-off during switching, attempts have been made to replace such AgCdO-based contact materials with other main metal oxide additives such as $SnO_2$, ZnO, $In_2O_3$, and CuO etc. However, contact materials of $AgSnO_2$ without further metal oxide additives cannot meet all the contact characteristic requirements. Contact materials based on $AgSnO_2$ with other metal oxide additives such as $In_2O_3$ and $Bi_2O_3$ are known.

It is an object of the present invention to improve the known $AgSnO_2$ contact materials with other metal oxide additives by reducing significantly the concentrations of the other metal oxide additives, especially those which are toxic.

This object, as well as other objects which will become apparent from the discussion that follows, are achieved, according to the invention, by providing $Bi_2O_3$, CuO and optionally CdO as the other metal oxides so that the total metal oxide content is between 10 and 25 percent by volume with an $SnO_2$ share equal to or greater than 70 percent by volume of the total amount of oxide.

A total metal oxide content of between 15 and 20 percent by volume has proven to be particularly advantageous.

According to one preferred embodiment of the invention, an $AgSnO_2Bi_2O_3CuO$ material has an Ag content of 87.95 percent by weight, an $SnO_2$ content of 9.97 percent by weight, a $Bi_2O_3$ content of 0.98 percent by weight and a CuO content of 1.10 percent by weight.

According to another preferred embodiment of the invention, the contact material consists of $AgSnO_2$-$Bi_2O_3CuOCdO$ with a $Bi_2O_3$ content between 0.5 and 2 percent by weight, a CuO content between 0.5 and 1.5 percent by weight and a CdO content between 0.05 and 2 percent by weight, in particular, the material may have an Ag content of 87.89 percent by weight, an $SnO_2$ content of 9.92 percent by weight, a $Bi_2O_3$ content of 1.1 percent by weight, a CuO content of 1.2 percent by weight and a CdO content of 0.3 percent by weight.

DETAILED DESCRIPTION OF THE INVENTION

The production of the material, and thereafter, of a contact element according to the invention is explained below by way of two examples of illustrative embodiments.

EXAMPLE 1

Production of an $AgSn_2Bi_2O_3CuO$ sintered contact material and of a contact element with this material.

An AgSnBiCu alloy of the above composition is formed from a melt of 90.15 percent by weight fine silver granules, 8.05 percent by weight tin granules, 0.90 percent by weight metallic bismuth fragments and 0.90 percent by weight copper in rod form. An alloy powder of the same composition is made therefrom by pressure atomization with water. After drying, the powder fraction smaller than 200 μm is screened off. This fraction is internally oxidized in air between 500° and 800° C., to obtain a compound $AgSnO_2Bi_2O_3CuO$ having the composition 87.95 percent by weight Ag, 9.97 percent by weight $SnO_2$, 0.98 percent by weight $Bi_2O_3$ and 1.10 by weight CuO.

Electrical contact elements can be produced from this compound powder by pressing the powder in a die at 600 MPa. For reliable connection bonding by brazing it is desirable to press the compound powder, which forms the contact side of the elements, together with a second pure silver powder layer which forms the connection side of the element. The contact elements, so formed, are sintered at 850° C. for one hour in air and then compacted by a hot pressing operation at 650° C. and 800 MPa. Further compacting and strengthening can be achieved by a second sintering at 850° C. for one hour in air and a subsequent further cold compaction.

The contact properties of such contact elements were measured in a test switch. Compared to an extruded $AgSnO_2$ contact element of identical oxide content, the burn-off was approximately 25 percent less. Fifty percent lower $F_{S99.9}$ values (welding forces) and 10 percent lower contact resistance values were also achieved. The structure of the contact material is very fine and uniform.

EXAMPLE 2

Production of an $AgSnO_2Bi_2O_3CuOCdO$ sintered contact material and of a contact element with this material.

A powder of particle size smaller than 200 μm is produced from an alloy of AgSnBiCuCd having 90.06 percent by weight Ag, 7.67 percent by weight Sn, 1.01 percent by weight Bi, 0.98 percent by weight Cu and 0.27 percent by weight Cd, for instance by pressure atomization with water. A compound powder of $AgSnO_2Bi_2O_3CuOCdO$ with 87.89 percent by weight Ag, 9.92 percent by weight $SnO_2$, 1.1 percent by weight $Bi_2O_3$, 1.2 percent by weight CuO and 0.3 percent by weight CdO is obtained by internal oxidation of the alloy powder. The internal oxidation is carried out during a heat treatment in air at a temperature between 500° and 800° C. The duration of this heat treatment is selected to achieve complete internal oxidation.

As in Example 1, a two-layer powder blank is produced from the compound powder. The blank is solidified by sintering, and the residual porosity of the contact element is reduced by a subsequent hot or cold compaction. This contact material thus obtained has the good contact properties. A structure picture showed uniformly globular oxide separations in the silver base metal.

The silver-tin oxide contact materials with the further oxide additives $Bi_2O_3$, CuO and optionally CdO according to the invention represent one of the multiplicity of possibilities for specific material selection with a very specific composition. In the contact materials with CdO as an oxide additive, it was possible to lower the CdO content by 1 to 2 orders of magnitude.

It should be noted that the composition of this contact material corresponds to one of the contact zone materials disclosed in the previously cited concurrently filed patent application.

There has thus been shown and described novel electrical contact material which fulfills all the objects and advantages sought therefor. Many changes, modifications, variations and other uses and applications of the subject invention will, however, become apparent to those skilled in the art after considering this specification which discloses preferred embodiments thereof. All such changes, modifications, variations and other uses and applications which do not depart from the spirit and scope of the invention are deemed to be covered by the invention which is limited only by the claims which follow.

What is claimed is:

1. In sintered contact material for low voltage electrical power switchgear consisting of $AgSnO_2$ and two other metal oxide additives, the improvement consisting of $Bi_2O_3$, and CuO provided as the other metal oxides, and wherein the total metal oxide content is between 15 and 20 percent by volume with the $SnO_2$ share of at least 80 percent by volume of the total amount of oxide.

2. A material for low voltage heavy electrical current contacts consisting of $AgSnO_2$ and two other metal oxide additives being $Bi_2O_3$ and CuO, and wherein the total metal oxide content is between 15 and 20 percent by volume with the $SnO_2$ share of at least 80 percent by volume of the total amount of oxide, consisting of $AgSnO_2Bi_2O_3CuO$ with an Ag content of 87.95 percent by weight, an $SnO_2$ content of 9.97 percent by weight, a $Bi_2O_3$ content of 0.98 percent by weight and a CuO content of 1.10 percent by weight.

3. A material for low voltage heavy electrical current contacts consisting of $AgSnO_2$, CdO, and $Bi_2O_3$, and CuO provided as other metal oxides, and wherein the total metal oxide content is between 15 and 20 percent by volume with the $SnO_2$ share of at least 80 percent by volume of the total amount of oxide, consisting of Ag content of 87.89 percent by weight, an $SnO_2$ content of 9.92 percent by weight, a $Bi_2O_3$ content of 1.1 percent by weight, a CuO content of 1.2 percent by weight and a CdO content of 0.3 percent by weight.

* * * * *